US005474229A

United States Patent [19]

Shimazaki

[11] Patent Number: 5,474,229

[45] Date of Patent: Dec. 12, 1995

[54] METHOD AND APPARATUS FOR STACKING PRESSURE-SENSITIVE ADHESIVE ENVELOPES

[76] Inventor: Junji J. Shimazaki, 1539 Lincoln Way #204, McLean, Va. 22102

[21] Appl. No.: 317,871

[22] Filed: Oct. 4, 1994

[51] Int. Cl.[6] ..... B65D 27/10; B65D 27/16; B65D 27/04

[52] U.S. Cl. ..... 229/69; 229/80; 229/71

[58] Field of Search ..... 383/37, 62, 84, 383/86, 32; 229/69, 80, 80.5, 71

[56] References Cited

U.S. PATENT DOCUMENTS

| | | | |
|---|---|---|---|
| 2,014,914 | 9/1935 | Teicher | 229/80 |
| 2,037,420 | 4/1936 | Lindgren | 229/80 |
| 2,087,410 | 7/1937 | Lane et al. | 229/80 |
| 2,114,380 | 4/1938 | Heywood | 229/80 |
| 2,217,949 | 10/1940 | Heywood | 229/69 X |
| 2,384,223 | 9/1945 | Wilbur | 229/80 X |
| 3,372,861 | 3/1968 | Johnson et al. | 229/80 |
| 3,508,949 | 4/1970 | Grossman et al. . | |
| 4,633,508 | 12/1986 | Sanders | 383/62 X |
| 5,041,072 | 8/1991 | McClelland . | |

FOREIGN PATENT DOCUMENTS

| | | | |
|---|---|---|---|
| 2036692 | 7/1980 | United Kingdom | 383/84 |

*Primary Examiner*—Jes F. Pascua

[57] ABSTRACT

The present invention relates to a stack of pressure sensitive adhering envelopes wherein each envelope can be easily removed from the stack and used without having to moisten the flap. The flaps of the envelopes are treated on the back side with a release coating and on the front side with a pressure sensitive adhesive so that when the envelopes are stacked with the flaps open, the adhering interface between the pressure sensitive adhesive and the release coating is not permanent. Each envelope in the stack can be easily removed from the stack and sealed by folding the flap onto the body portion of the envelope and applying a slight pressure onto the flap. No release tape is required because each adjacent envelope is treated with the release coating.

20 Claims, 4 Drawing Sheets

METHOD AND APPARATUS FOR STACKING PRESSURE-SENSITIVE ADHESIVE ENVELOPES

The present invention relates to a plurality of pressure sensitive adhering envelopes stacked with the flaps open and adhered together. A release coating is applied to the back of each flap and a pressure sensitive adhesive is applied to the front of each flap such that each envelope can be easily separated and removed from the stack to expose the adhesive. Because the front of each flap is coated with a pressure sensitive adhesive material, the envelopes can be sealed without having to moisten the flap.

BACKGROUND OF THE INVENTION

Envelopes are commonly sealed by wetting or moistening an adhesive material on the flap. Typically, the moistening is accomplished by licking the adhesive. This is not only distasteful but is also likely to leave bacteria on the envelope. Sponges and other devices have been made to provide moisture to the flap. The disadvantage is that effort must be made to wet the envelope to seal it properly.

One alternative envelope is one which uses a pressure sensitive adhesive strip on the inside of the flap with a release tape which covers the adhesive until the envelope is ready for use. The disadvantage of this type of envelope is that a separate release tape must be used. Not only is this more costly to manufacture but it is also cumbersome for the user because the tape has to be pulled off with each use. In addition, the separate tape must be disposed. As is often the case, the separate tape winds up on the floor or as additional garbage to be disposed.

SUMMARY OF THE INVENTION

The present invention represents a significant improvement over past envelopes in that it comprises a plurality of pressure-sensitive adhering envelopes stacked together so that a user can easily remove an envelope from the top of the stack, and seal the envelope without having to moisten the flap. Each envelope is pre-coated on the front or inside of each flap with a pressure-sensitive adhesive which can bond and seal the envelope. The opposite or back side of each flap is pre-treated with a release coating. The envelopes are stacked with the flaps open so that the front "tacky" side of each envelope flap is adjacent and adheres to the release coated back side of an adjacent envelope flap. The release coating allows each adjacent envelope in the stack to be easily removed from the stack because the release coating prevents the adhesion between any two adjacent and opposite flaps from being permanent. That is, the envelopes can easily be peeled or separated from one another when desired.

When an envelope is desired for use, one merely has to peel the top envelope from the stack. This separates the top envelope from the remainder of the stack of envelopes and exposes the pressure sensitive adhesive material. Once the contents, including paper or any other suitable item, is placed into the envelope, the flap can easily be folded and sealed by merely pressing the flap lightly onto the body of the envelope. The pressure-sensitive adhesive material substantially permanently bonds to the non-treated plain paper body portion of the envelope with only slight pressure to seal the envelope. The envelopes also have creases and are pre-folded and opened to allow the flap to be easily closed.

When another envelope is desired, the same procedure is followed with the next adjacent envelope. Each envelope is removed one-by-one in this manner so that they can all be utilized easily without having to moisten the flaps and without having to remove any tape material. A release coated bottom sheet can be provided for the bottom envelope so that the bottom envelope can also be peeled off and used as well.

An advantage of the present invention is that by simply removing an envelope from the stack, the pressure sensitive adhesive layer on the inside of the flap is exposed. This enables the envelopes to be sealed merely by folding and pressing the envelope with slight pressure. Each flap does not have to be moistened as the adhesive material will affix itself to the plain paper body portion of the envelope merely by adding pressure. Because a release coating material surface is applied to the back side of each adjacent envelope, there is no need for a separate release tape.

The adhesive also temporarily bonds the envelopes together in a neat stack until ready for use. No storage box is needed. The stack of envelopes can fit easily into a drawer or cabinet or can be placed on a desk for easy access.

The description contained herein is intended to illustrate the essential concepts comprising the invention and is not intended to limit the invention to the specific embodiments described. The following drawings and description are provided to more specifically describe the invention.

DETAILED DESCRIPTION OF THE INVENTION

Figure 1:
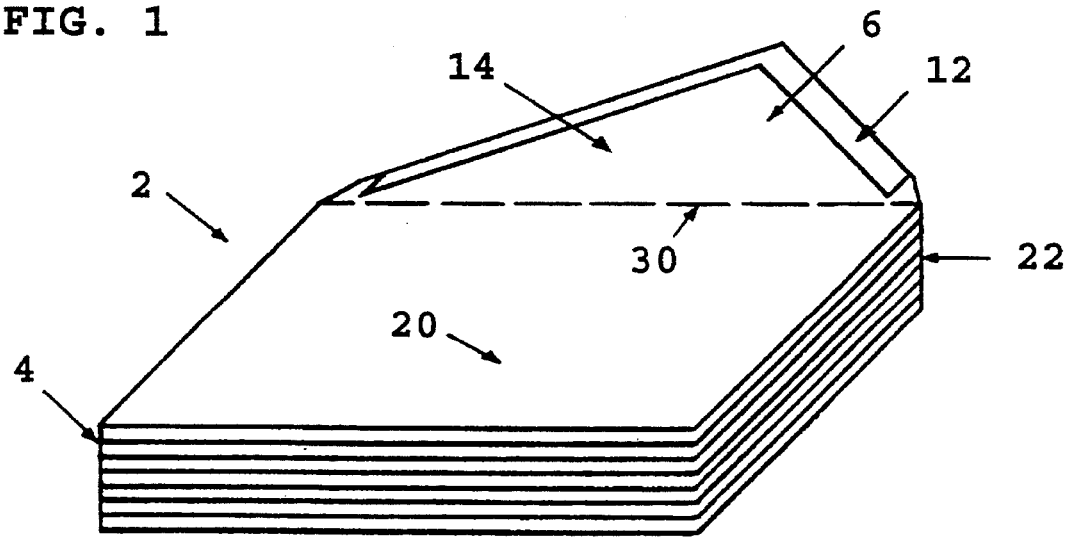
FIG. 1 represents a perspective view of a stack of envelopes of the present invention.
Figure 2:
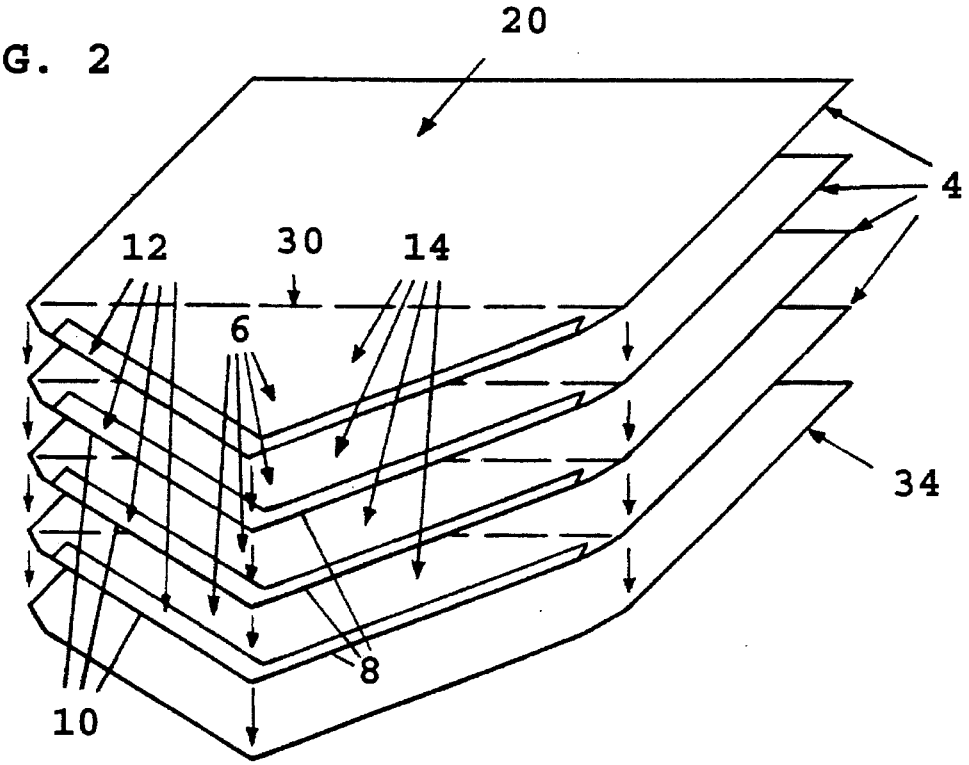
FIG. 2 is a schematic view showing how the envelopes are stacked.

As can be seen in FIG. 1, the present invention 2 comprises a plurality of envelopes 4 stacked one on top of each other with the flaps 6 open. Each envelope 4 is made of a thin material and is preferably generally rectangular in shape with a flap 6 to seal the envelope extending from the top of the envelope. The stack preferably comprises a multiple layer of envelopes 4 each facing the same direction and aligned along the edges 22. As seen in FIG. 2, the envelopes are positioned in stack form with the front side of each flap 10 facing the back side of the corresponding flap 14 of the envelope immediately adjacent it.

Figure 3A:
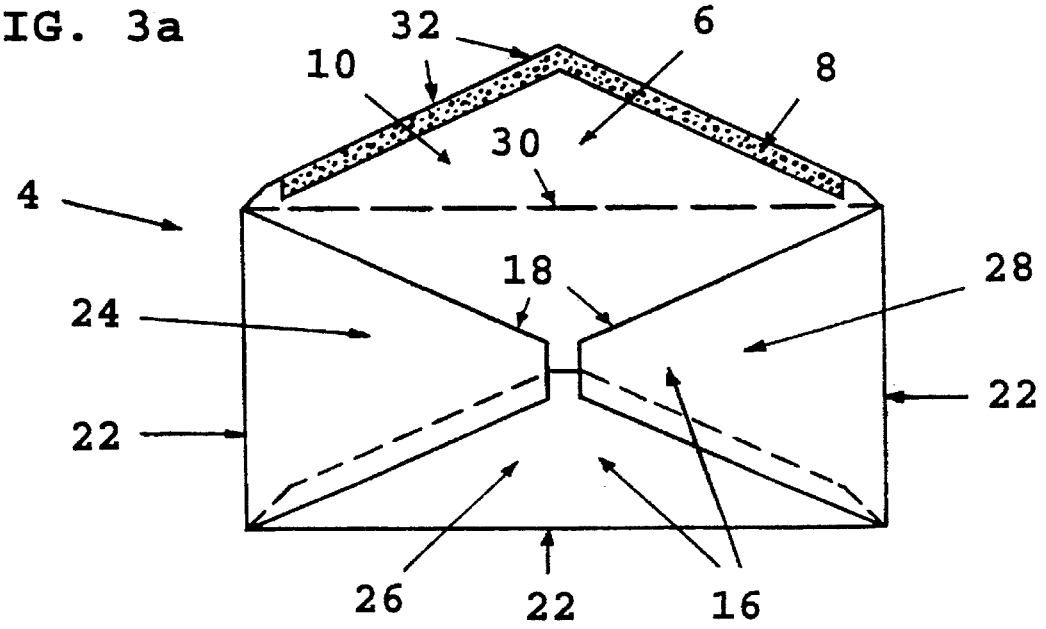
FIG. 3*a* is a front view of an envelope of the present invention.
Figure 3B:
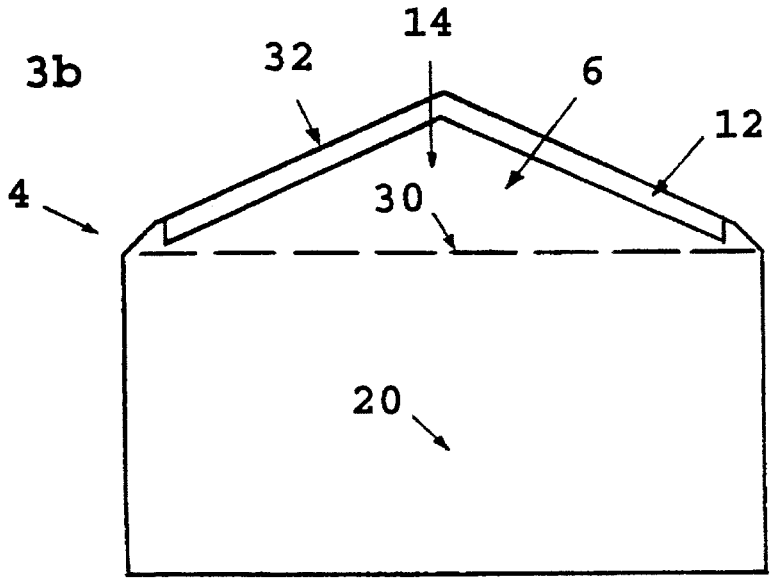
FIG. 3*b* is a back view of an envelope of the present invention.
Figure 4A:
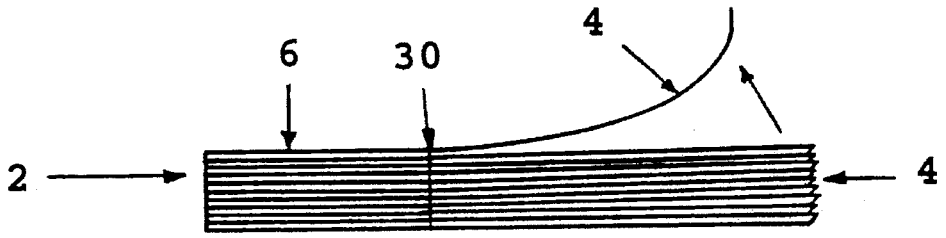
FIGS. 4*a* and 4*b* are schematic drawings showing how the envelopes can be removed from the stack.
Figure 4B:
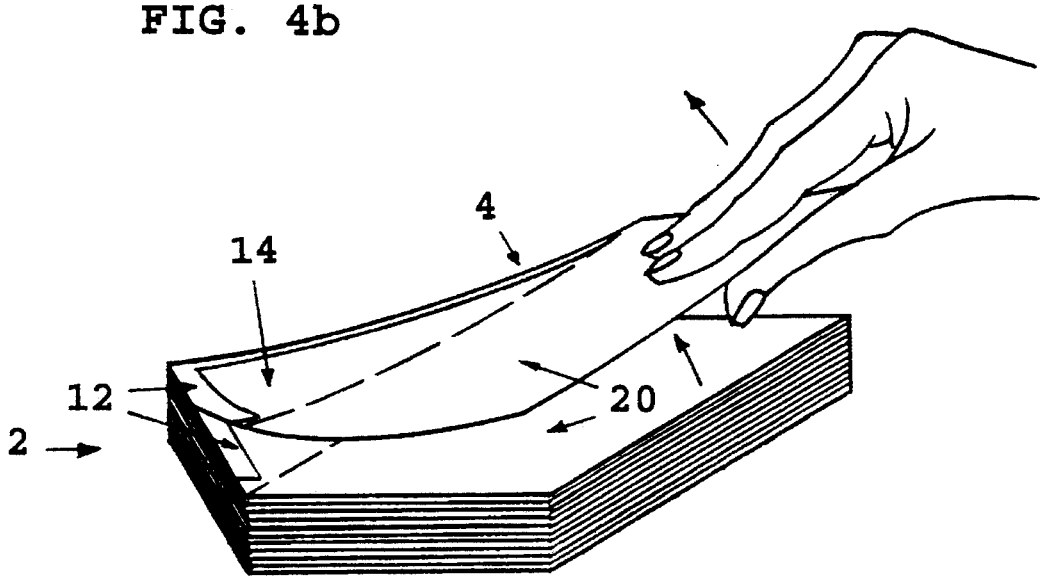

As seen in FIGS. 3*a* and 3*b* pressure sensitive adhesive material 8 is placed on the front or open side 10 of each flap, and a release coating material 12 is placed on the corresponding back side 14 of each flap. Because the back of each flap is treated with a release coating 12, the pressure sensitive adhesive material 8 does not bond the flaps 6 of adjacent envelopes permanently when stacked as shown in FIG. 2. Each envelope can be peeled and removed easily one-by-one from the stack when needed as shown in FIGS. 4*a* and 4*b*. Because only the back side of the flaps are treated with a release coating, the adhesive material 8 on the front side of the flap 10 bonds to the non-treated plain paper body portion 16 of the envelopes. This is accomplished merely by folding and closing the flap which brings the pressure sensitive adhesive material into contact with the body of the envelope. The envelope is sealed by merely adding slight pressure to the flap.

Each envelope 4 can be of any standard size and shape, but is preferably rectangular and sized appropriately to permit insertion of any manner of materials including letters etc. As with most standard envelopes, each one is formed from a single web or sheet of paper, or any other suitable thin material, folded and glued to form a flat, thin folded pouch or pocket 18. Although the term "paper" will be used throughout, that term is intended to include any suitable thin material, including plastics or vinyl, which can be used as well.

As is typical of most envelopes, the envelopes 4 are formed in a generally rectangular outline shape 20 wherein a single sheet of paper is folded forward along a rectangular crease 22. Each of the three lower flaps 24, 26 and 28 extend from the creases and are folded forward and secured together in overlapping fashion on the front side 16 to form a flat pouch or pocket 18 as shown in FIG. 3*a*. The three flaps 24, 26 and 28 can be secured with glue or any suitable adhesive to form the pouch 18. Essentially, the back side consists of the rectangular portion of the sheet 20 and the front side is formed from the three flaps 24, 26 and 28. The upper flap 6 also has a line of weakness or crease 30 along the lower edge where it meets with the body of the envelope. In the stack, the upper flap 6 is left open so that the front side 10 is adjacent the back side 14 of a corresponding adjacent envelope. The upper flap 6 when desired can be folded along the crease or line of weakness 30 and serves to seal the envelope. Although the preferred envelope is rectangular, any shape and structure of envelope is within the contemplation of this invention, including square envelopes.

The flap 6 of each envelope is treated on the back side with the release coating material 12. The release coating material can be any of a plurality of commercially available materials such as those manufactured by Dow Chemical or General Electric. The preferred release coating is one containing what is colloquially known in the art as "silicon". Although any suitable release coating material can be used, it is important that it have characteristics which are compatible with the paper and with the adhesive material as will be discussed. The surface of the paper upon which the release coating is applied is preferably smooth to make it easier for the coating to be applied and for better performance of the release coating. With certain grades of paper it may be preferable that the surface be made smooth before applying the coating. This can be accomplished by machine finishing, or calendaring, or the like. The release coating can be applied in a thin laminate form in any manner as is known in the industry, as by a roller, spray nozzle or other conventional means. The thickness of the coating need only be sufficient to provide the necessary release characteristics as will be discussed. The coating is then conventionally dried or cured, such as by air and heat, or ultraviolet light, or whatever means achieves the desired result. Although the coating is preferably placed as a strip along the edge 32 of the flap 6, it is sufficient that it be applied to cover an area large enough to provide a release surface for the adhesive material.

The pressure sensitive adhesive material 8 is applied in a manner which results in the adhesive 8 being positioned on the front side 10 of each flap 6 at the time the envelope is ready for use. This can be accomplished by applying the adhesive 8 in laminate form onto the front side 10 of the flap 6. The adhesive can be applied by any conventional means, such as by roll or spray. Preferably, the adhesive is applied evenly and in a manner sufficient to provide the necessary shear resistance as is known in the art. Application of the adhesive so as to eliminate streaking or excess build up is also preferred.

Application of the adhesive can also be accomplished when stacking is desired by applying the adhesive in laminate form onto the release coating itself after the release coating has dried or cured. Stacking the envelopes as will be discussed will bring the adhesive layer 8 into contact with the front side 10 of each adjacent envelope. Because the strength of the bond between the adhesive 8 and the release coating 12 will be much less than the bond between the adhesive and the untreated front side 10 of the flap 6, when an envelope is eventually peeled from the stack, the adhesive layer 8 will remain on the plain paper surface of the front side 10 of the flap 6 and be removed from the back side 14. The effect is that the adhesive will be on the front side 10 and the release coating on the back side 14. The top and bottom envelope will, of course, have to be treated so that there is no adhesive on the back side of the top envelope and that there is adhesive on the from side of the bottom envelope.

Any suitable and compatible pressure sensitive adhesive material commercially available can be used, including those containing an acrylic or rubber base, which are manufactured by such companies as Monsanto and Ashland Corporation and used by such companies as the 3M Corporation. Pressure sensitive adhesive is one that is tacky at room temperature, and which tenaciously adheres to a variety of surfaces by mere contact with only slight pressure. Preferably, the tackiness of the adhesive will not change over a period of time so that the adhesive will not lose its ability to permanently bond with an applied substrate. It is also preferable that the adhesive material have a low creep factor so as to minimize migration of the adhesive along the substrate and to prevent bleeding of the adhesive into the substrate material. These properties are well known in the art. Additional information concerning properties of pressure sensitive adhesives and release coatings can be found in any number of resource materials, including *Handbook of Pressure-Sensitive Adhesive Technology*, by Don Satas, the relevant portions of which are incorporated herein by reference.

The tackiness of the preferred adhesive is such that it bonds permanently to the main substrate. "Permanent" means that the adhesive is nearly or greater than the strength of the substrate material it is applied to such that removal of one surface from the other is difficult or impossible without damaging the substrate material. Preferably, the adhesive 8 can bond within a certain time permanently to the non-treated body portion of the envelope 16 although a wide degree of adhesiveness is within the scope of the present invention. Although many different materials are commercially available which will perform adequately, the pressure sensitive adhesive 8 and the release coating 12 are preferably compatible with one another. By compatible, it is meant that the adhesive and release material is such that the adhesive can easily be removed from the release coating, while the adhesive is sufficient to bond well with the plain non-treated paper surface of the body 16 of the envelope. The preferred adhesive is one which bonds permanently to the adhered surface such that it causes damage or fiber tear within approximately 30 minutes of application, although this time period can be more or less depending on the desired results. The preferred adhesive is also one which will allow the adhesive surface to be repositioned with respect to several surfaces, without damaging the substrate, within approximately 10 seconds of application, although this time period can also be more or less depending on the desired results. This aspect of the invention provides flexibility in that it allows the user to seal and unseal the envelope when desired for a period of time before the envelope is permanently sealed. Adhesives having these characteristics are used in the industry by companies such as 3M Corporation. However, this aspect is not necessary for the invention to perform in the intended manner. It should also be understood that it is prefered but not necessary that the envelopes be permanently sealable. Envelopes for mailing purposes are preferably permanently sealable so that accidental or unauthorized openings do not occur.

The release coating should be compatible with the particular adhesive such that only a slight amount of force or peel adhesion is required to separate the interface between the adhesive material and the release coating. The separation should easily occur with only a minimal amount of force applied at a 90 degree angle without any adhesive material being lifted and causing no damage to the substrate. Although ease of removal is important, the release coating should nevertheless permit the adhesive to bond slightly so that the envelopes will stay together in the stack when not being used. The release coating should also be applied and cured properly such that it does not come off onto the adhesive. Otherwise, the release coating could cause the adhesive to lose its tack properties.

The materials should also be compatible so that they can be applied and co-exist on opposite sides of the same sheet of paper. In particular, the materials and their application should be selected so that the respective viscosity of the materials do not permit passage of the materials through the pours of a given substrate. This may require an additional layer of a sealing material, such as polyethylene in the case of the release coating being applied to paper. This additional coating may be necessary if the paper is too porous or not sufficiently smooth. A smooth substrate is preferred insofar as the release coating can be applied more easily on a smooth surface. Nevertheless, most types of paper are or can be made sufficiently smooth for the release coating to be applied properly as discussed. To further help keep the release coating separate from the adhesive, the release coating should be properly dried or cured before the adhesive material is applied.

These characteristics are provided to disclose the preferred characteristics of the materials being used. However, it should be emphasized that the present invention is intended to comprise the broad concept of stacking self-adhering envelopes described herein, and that not all of these characteristics are necessary for the present invention to fulfill its intended use.

Other characteristics which are known in the art are also preferred although not required. The preferred adhesive is one which does not cause the paper to which it is applied to curl, that is, the tendency of the paper by itself or in the laminate to bend or wrap around itself. The preferred adhesive should also not migrate or penetrate (bleed through) the surfaces so as to change the appearance of the surfaces to which it is applied. The materials should also age in a manner which does not alter the basic properties of the materials including their appearance, viscosity and consistency. The adhesive should also be of a consistency which does not ooze or squeeze out from between the envelopes.

As mentioned, the release coating 12 should be applied to an area sufficient to cover the adhesive surface 8 of an adjacent envelope so that when the envelopes are stacked, none of the adhesive material sticks to the non-treated plain paper portion of the adjacent envelope. The release coating surface is preferably similar in shape and size to the adhesive coating surface although it is preferably slightly larger than the adhesive surface, although not necessarily so, to permit some margin of error in the alignment of the stack of envelopes. As long as the release coated area fully covers the corresponding adhesive area of an adjacent envelope, the envelopes will separate properly. The adhesive material is also preferably applied in strips 8 continuously on the flaps 6 so as to provide proper closure of the envelope. If material cost is important, the materials can be placed intermittently along the edge. Edge placing of the adhesive materials on the flaps is not necessarily preferred because of the tendency of the adhesive to squeeze out from between the envelopes causing the edges to be tacky to the touch. It is sufficient that the adhesive be applied close to the edge 32 of the flaps but not all the way to the edge. On the other hand, adhesives are known in the art which have non-creeping properties so that placement of the adhesive on the edge 32 can be acceptable. The release coating, however, can extend to the edge 32 without any adverse consequences.

Once the flaps 6 are treated, the envelopes are stacked open-faced as shown in FIG. 2 so that the adhesive surface of a corresponding flap is positioned adjacent the release coated surface 12 of a flap of an adjacent envelope. In the preferred embodiment, the envelopes are stacked with the adhesive side of the flaps facing down so that the adhesive is not exposed until the envelope being used is peeled from the stack. A release coated paper 34 is provided at the bottom of the stack so that the bottom envelope can be used as well. The envelopes are preferably stacked neatly so that the edges are aligned to form a compact stack. Any number of envelopes can be stacked but preferably between 10–50 to permit proper stacking although 50 to 100 envelopes are also well within the contemplation of the invention. A stiff border, made of cardboard or other suitable material, can be provided on one or more sides to retain the shape and structure of the stack. The border can be provided to cover the potentially tacky edge of the flaps. A housing or dispenser can also be provided to make it easier to use, in which case stacks of more than 100 envelopes are feasible.

The thickness of the adhesive and release coating layers preferably allow the envelopes to be stacked substantially evenly as shown in FIG. **4*a* although not necessarily so. As previously discussed, the body of the envelopes typically comprise a back side 20 and three flaps 24, 26 and 28** folded and secured. This body portion is therefore thicker than the single open flap portion of the envelope. While this difference is insignificant in terms of one envelope, when a great number of envelopes are stacked, this difference is significantly multiplied. When stacked with the flaps adhered to one another, the total thickness of the flaps in the stack is otherwise much less than the thickness of the body of the envelopes. The present invention can compensate for this difference in thickness by virtue of the additional thickness of the adhesive and release coating materials. The total thickness of the flaps, including the paper and the adhesive and coating materials, can be made so that they are almost substantially the same as the total thickness of the body portions. This is accomplished by the mere thickness of the layers of materials, or if additional thickness is desired, introducing inexpensive inert additives into the materials or providing additional layers of coating. In this fashion, when the envelopes are stacked, the flap and body portions are substantially even. This also contributes to the envelopes being neatly stacked and having a neat appearance and not being susceptible of being removed from the stack until needed. Nevertheless, it is understood that the present invention need not be stacked with even thickness to provide the benefits discussed above.

In use, one merely removes an envelope by peeling the body of the envelope perpendicularly away from the stack. With one's fingers, one merely takes hold of one envelope and lifts upward as shown in FIG. 4*b*. The upward motion easily separates the flap of that envelope from the envelope immediately below. Because of the release coating surface 12 on the back side of the flap 14 of the envelope immediately below, the adhesive layer of the envelope being pulled is easily separated and the envelope is easily removed. Once the envelope is separated, the adhesive is exposed. Thereafter, the contents can be placed inside the mouth 18 of the envelope and then the flap 6 can be folded along the line of weakness 30 and brought into contact with the body of the envelope 16 to seal the envelope. The envelopes are precreased or provided with a line of weakness 30 along the lower edge of the flap so that the flap can be easily folded. Because the body portion of the envelope 16 is not treated with a release coating, the adhesive adheres to the plain paper and bonds to substantially permanently seal the envelope with only slight pressure. The present invention makes it easy to use large quantities of envelopes such as for mass mailings because there is no need to moisten the envelopes.

Any printing can be applied to the envelopes prior to stacking. During use, addresses can also be written onto the envelope before the envelope is pulled from the stack, or can be written or typed after the envelope is separated from the stack. To make it easier to type onto an unsealed envelope which has already been removed from the stack, a separate reusable release coated sheet can be provided. The separate sheet is preferably a sheet folded so that it fits onto and over both sides of the flap and allows easy insertion of the envelope into a typewriter. Address labels and windows 36 can also be provided for particular uses.

Figure 5:
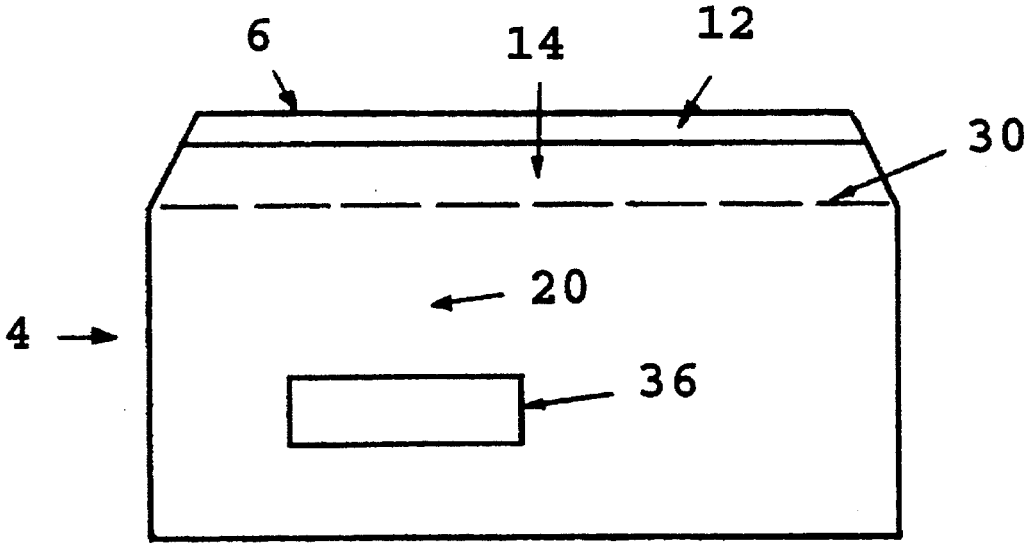
FIG. 5 represents an alternative embodiment.

In alternate embodiments, the envelopes can have any manner of construction and shape. The flap can be straight across as shown in FIG. 5 which makes it easier to apply the adhesive and release materials in strips. The essential concept of stacking self-adhering envelopes can be used in conjunction with any suitable envelopes of any shape, color or size. The envelopes can be made with cut-out windows 36 for address inserts as shown in FIG. 5, or can be pre-printed with addresses, logos or designs. The envelopes can also come in different colors—the entire stack can be a particular color, or each envelope in the stack can be a different color, or some combination, such as a rainbow of colors. The flaps can also be designed and cut-out in unique shapes. In stack form, the shape of the flap can be used as a possible trademark or other identifying symbol. The color and shape of the release coating surface can also be modified to present a unique idea, logo, writing or design. The adhesive and release coating can spell out the name of a company or other slogan.

The present invention has been described in terms of the embodiments disclosed herein. However, other embodiments with modifications not specifically disclosed which encompass the concepts disclosed herein are also within the contemplation of the present invention and are intended to be included with reference to the following claims.

What is claimed is:

1. A stack of envelopes comprising:

at least two envelopes removably adhered together to form a stack, wherein each envelope in the stack comprises:

an envelope back wall having a sealing flap extending therefrom, said sealing flap having a front side and a back side;

an envelope front wall in overlapping relation to said back wall, wherein a pocket is formed between said envelope front wall and said envelope back wall; and wherein at least a portion of said sealing flap front side has thereon a pressure sensitive adhesive material, and at least a portion of said sealing flap back side has thereon a release coating;

wherein each of said envelopes are stacked together with the sealing flaps facing substantially the same direction, wherein between adjacent envelopes in the stack, the sealing flap front side of one envelope is positioned adjacent the sealing flap back side of an adjacent envelope, and, wherein the pressure sensitive adhesive of one envelope is positioned directly adjacent the release coating of an adjacent envelope in the stack, wherein the envelopes in the stack are adhered together by said adhesive, whereas, the release coating permits the envelopes to be easily separated from the stack and each other when needed.

2. The stack of envelopes of claim 1, wherein separating an envelope from the stack exposes the pressure sensitive adhesive, such that the envelope can be sealed, without having to remove a protective tape or liner, by folding and closing the sealing flap, and bringing the pressure sensitive adhesive into contact with the envelope front wall.

3. The stack of envelopes of claim 2, wherein the pressure sensitive adhesive of each envelope is substantially permanent, such that it bonds substantially permanently after the adhesive is brought into contact with the envelope front wall.

4. The stack of envelopes of claim 3, wherein the pressure sensitive adhesive of each envelope is initially repositionable, and bonds substantially permanently within about 30 minutes after the adhesive is brought into contact with the envelope front wall.

5. The stack of envelopes of claim 1, wherein each envelope sealing flap has an upper edge, and wherein the pressure sensitive adhesive material of each envelope is applied up to and along at least a portion of the edge of the sealing flap front side, and wherein the release coating of each envelope is applied up to and along at least a portion of the edge of the sealing flap back side.

6. The stack of envelopes of claim 1, wherein each envelope in the stack is adhered together such that, between adjacent envelopes, substantially all of the surface area of the pressure sensitive adhesive of one envelope is covered by and in direct contact with the release coating of an adjacent envelope in the stack.

7. The stack of envelopes of claim 1, wherein a bottom release sheet is provided and adhered to the bottom envelope in the stack.

8. The stack of envelopes of claim 1, wherein each of the envelopes in the stack are formed from a single sheet of paper, wherein the envelope front wall is formed from three overlapping flaps folded and glued together, and the sealing flap is an extension of the envelope back wall, separated by a line of weakness that permits the sealing flap to be easily folded and closed.

9. The stack of envelopes of claim 1, wherein the envelopes are neatly stacked together and aligned, wherein up to 50 envelopes are stacked and adhered together in a single stack.

10. A stack of envelopes, comprising:

at least two envelopes removably adhered together to form a stack of envelopes, wherein each envelope comprises:

a body portion having a body front side and a body back side, wherein a pocket is formed between said body front side and said body back side;

a sealing flap extending from said body back side, said sealing flap having a front side and a back side;

wherein at least a portion of said sealing flap front side has thereon a substantially permanent pressure sensitive adhesive material, and wherein at least a portion of said sealing flap back side has thereon a release coating;

wherein between adjacently adhered envelopes in the stack, the adhesive material of one envelope is positioned directly adjacent the release coating of an adjacent envelope, such that the envelopes are adhered together in the stack by said adhesive, wherein said release coating permits said envelopes to be adhered together, but prevents said adhesive from bonding the envelopes in the stack permanently together.

11. The stack of envelopes of claim 10, wherein the pressure sensitive adhesive material is initially repositionable, but bonds substantially permanently within a period of time after it is separated from the release coating, and brought into contact with the body front side.

12. The stack of envelopes of claim 11, wherein the pressure sensitive adhesive material bonds substantially permanently within about 30 minutes after the adhesive is brought into contact with the body front side.

13. The stack of envelopes of claim 10, wherein the pressure sensitive adhesive material is applied up to and along at least a portion of an edge of the upper flap front side, and wherein the release coating is applied up to and along at least a portion of an edge of the upper flap back side.

14. The stack of envelopes of claim 10, wherein each envelope in the stack is adhered together such that, between adjacent envelopes, substantially all of the surface area of the pressure sensitive adhesive material of one envelope is in direct contact with the release coating of an adjacent envelope in the stack.

15. The stack of envelopes of claim 10, wherein substantially all of the surface area of the pressure sensitive adhesive material of an envelope in the stack is adhered to and covered by the release coating of an adjacent envelope in the stack.

16. The stack of envelopes of claim 10, wherein the release coating is made from material containing silicon, and the adhesive material is made from material containing either rubber or acrylic.

17. A stack of envelopes, comprising:

at least two envelopes, each having a body formed from a single sheet of paper, said body comprising:

an envelope back wall having an upper flap extending therefrom, said upper flap having a front side and a back side;

an envelope front wall formed from three overlapping lower flaps extending from said envelope back wall, wherein said three overlapping lower flaps are folded and glued together to form a pocket; and wherein at least a portion of said upper flap front side has thereon a pressure sensitive adhesive material, and at least a portion of said upper flap back side has thereon a release coating;

wherein said envelopes are removably adhered together to form a stack of envelopes, such that the upper flap front sides are adjacent the corresponding upper flap back sides, wherein the adhesive material of one envelope is positioned directly adjacent the release coating of an adjacent envelope, wherein said adhesive and said release coating permits said envelopes to be adhered together, and to be separated from the stack and each other when needed.

18. The stack of envelopes of claim 17, wherein the pressure sensitive adhesive material is initially repositionable, but bonds substantially permanently to said envelope front wall within a period of time after the adhesive is separated from said release coating and comes into contact with said envelope front wall.

19. The stack of envelopes of claim 17, wherein the pressure sensitive adhesive is applied along an edge of the upper flap front side, wherein said adhesive extends substantially across the width of said upper flap front side.

20. The stack of envelopes of claim 17, wherein each of the envelopes have thereon a cut-out window.

* * * * *